United States Patent [19]

Viscovich

[11] Patent Number: 4,726,813

[45] Date of Patent: Feb. 23, 1988

[54] SOLID PARTICLE MAGNETIC DEFLECTION SYSTEM FOR PROTECTION OF STEAM TURBINE PLANTS

[75] Inventor: Paul W. Viscovich, Longwood, Fla.

[73] Assignee: Westinghouse Electric Corp., Pittsburgh, Pa.

[21] Appl. No.: 26,238

[22] Filed: Mar. 16, 1987

[51] Int. Cl.[4] ..... B03C 1/00

[52] U.S. Cl. ..... 55/3; 55/100; 55/396; 55/461; 55/432; 60/646; 60/657

[58] Field of Search ..... 60/646, 657; 55/3, 100, 55/395, 396, 461, 432

[56] References Cited

U.S. PATENT DOCUMENTS

| | | | |
|---|---|---|---|
| 2,622,937 | 12/1952 | Taylor | 55/3 X |
| 4,254,627 | 3/1981 | Gruber et al. | 60/646 |
| 4,458,148 | 7/1984 | Hirshfield et al. | 55/3 X |
| 4,505,824 | 3/1985 | Akamine et al. | 60/657 X |
| 4,512,851 | 4/1985 | Swearingen | 60/646 X |
| 4,679,399 | 7/1987 | Strickler | 60/646 |

FOREIGN PATENT DOCUMENTS

| | | | |
|---|---|---|---|
| 362640 | 2/1973 | U.S.S.R. | 55/100 |

*Primary Examiner*—Kathleen J. Prunner

[57] ABSTRACT

Metallic particles entrained in the flow of steam being supplied by a steam generator to a steam turbine, the metallic particles being entrained in the flow of steam and at least in part having exfoliated from boiler pipes of the steam generator, are deflected from an axially directed steam flow path outwardly, toward the outer circumference of the path at which they are trapped and collected and thereby removed from the steam flow supply to the turbine.

22 Claims, 4 Drawing Figures

SOLID PARTICLE MAGNETIC DEFLECTION SYSTEM FOR PROTECTION OF STEAM TURBINE PLANTS

BACKGROUND OF THE INVENTION

1. Field of the Invention

This invention relates to steam turbines and, more particularly, to a solid particle magnetic deflection system for removing or diverting metallic oxide particles entrained in and transported by a steam flow path enroute to a steam turbine, thereby to eliminate or substantially reduce erosion damage caused by solid particle impact within the steam turbine.

2. State of the Relevant Art

Damage to steam turbines due to solid particle erosion (SPE) is a matter of growing concern. During start-up of a steam turbine plant, particularly from a cold or shut-down condition, solid particles are exfoliated, i.e. spalled, from the surface of the boiler tubes within a steam generator which supplies the high pressure steam for driving the turbine. The particles become entrained in the steam flow and are transported through interconnecting piping to the steam turbine, passing through the associated stop and control valves enroute to the high pressure turbine inlet nozzles. The erosive damage to these parts can be extensive. Further, SPE damage results in reduced efficiency, and thus lost power generation, adding to the cost for repair and replacement of eroded components.

The exfoliation, entrainment and transport of the solid particles may be a continuous phenomenon, as the boiler tubes and steam piping of a system accumulate operating time at elevated temperatures. However, the primary occurrence of exfoliation appears to be at the time of start-up, after a steam turbine plant has been brought off-line and allowed to cool, during which time a metallic oxide scale forms on the inner surfaces of the boiler tubes. It is believed and generally accepted in the industry that the amount of oxide scale buildup in the interconnecting piping is minimal, at least compared with that in the boiler tubes. As the boiler is fired, the difference in thermal characteristics between the oxide and the parent material of the boiler tube results in separation of the oxide from the tube, i.e., exfoliation. A similar situation exists at the inlet to intermediate and/or low pressure turbines, as a result of metallic oxides emanating from first (and second) reheater tube walls.

The magnitude of the SPE problem and the concentrated effort in the industry to find practical solutions for it was the main topic of a symposium conducted by the Electric Power Research Institute (EPRI) held in Chattanooga, Tenn., Nov. 13–15, 1985. The proceedings of the EPRI meeting, under the general heading "Solid-Particle Erosion of Utility Steam Turbines: 1985 Workshop", included publications by Sumner, W. J. et al. "Reducing Solid Particle Erosion Damage in Large Steam Turbines," and by Miller, V. R. D. "Maintenance Strategies and Specific Design Changes to Ontario Hydros Lambton TGS Coal-Fired Generating Units to Mitigate the Effects of Solid Particle Erosion," among others. The Sumner et al. article reports that based on recent data at that time, the cost estimates for SPE damage are as great as $150 million per year.

Proposals have been made, and EPRI has funded research programs, for combating the SPE problem, directed, variously: to particulate reduction through chemical cleaning, chromate treatment and chromizing of boilers, to particulate removal through steam/air blowdown and through use of inertial separators; and to steam turbine armoring through plasma spray, diffusion bondings, and steam turbine blade and nozzle redesign. Operational schemes have also been proposed for reducing SPE damage, such as full-arc admission (taking into account the continuity equation of flow dynamics), which serves to reduce nozzle passage velocities and thereby the erosive effects of the impacting oxide particles. These schemes, however, have not satisfactorily solved the SPE problem, as evidenced by continued EPRI research programs.

There thus exists a continuing need for reducing the damage caused by SPE and particularly the erosion caused by solid particle impacting of steam turbine components, such solid particles being entrained in the steam flow and transported through interconnecting piping to the turbine and its internal components.

SUMMARY OF THE INVENTION

The present invention comprises a solid particle magnetic deflection system and related method of operation, for use in conjunction with steam turbines and, more particularly, for the removal of solid metallic oxide particles, such as magnetite ($Fe_2O_3$), which are exfoliated from boiler tubes and other piping and thereafter become entrained in the steam flow and transported through interconnecting piping to the steam turbine. The particles are diverted, or deflected, and thereby effectively removed from the steam flow path, prior to entry into the steam turbine, thereby to prevent or significantly reduce solid particle erosion (SPE) from occurring within the steam turbine.

The capability of a magnetic deflection system for accomplishing this function resides in the circumstance that the Curie temperature for the offending metallic oxide particles, i.e. the temperature at which such materials are no longer capable of exhibiting a magnetic property, is significantly above the operating throttle and reheat temperatures of the steam flow servicing the turbine. Accordingly, the system and method of the invention comprise the provision of electromagnets which are mounted at one or more pre-determined locations on both main and reheat steam lines which provide a steam flow to a steam turbine. The high intensity magnetic field produced by each of the electromagnets, the field axis being generally aligned with the axial direction of the flow in which the metallic oxide particles are entrained, diverts the particles to one or more desired locations. At each such location there is provided, in accordance with alternative embodiments of the invention, a surface skimmer device or a quiescent zone adjacent to the steam flow path, which traps and collects or accumulates the deflected particles until such time as removal is practical and permitted.

While not so limited in operation, a preferred method of use of the deflection system is to energize the electromagnets at the time of start-up and to maintain the energized condition until the SPE condition has passed, at which time the system may be de-energized. The system may also be activated, preferably automatically, in response to load cycling or other operating conditions which may produce the SPE condition. As will be appreciated, maximum benefits and maximum efficiency in terms of the energy consumption by the electromagnets, are realized by energization of same at the time of plant start-up and thus when steam temperatures are low, initially, through full load conditions, followed by de-energization when exfoliation has ceased. The system and method of operation of the invention thus may contribute significantly to increasing the sustained performance levels of the steam turbine system, such as in public utilities and other applications, and thus to reducing maintenance and replacement costs and the associated downtime and loss of power generating revenues.

These and other objects and advantages of the present invention will become more apparent with reference to the attached, detailed description and related drawings.

DETAILED DESCRIPTION OF THE PREFERRED EMBODIMENT

Figure 1:
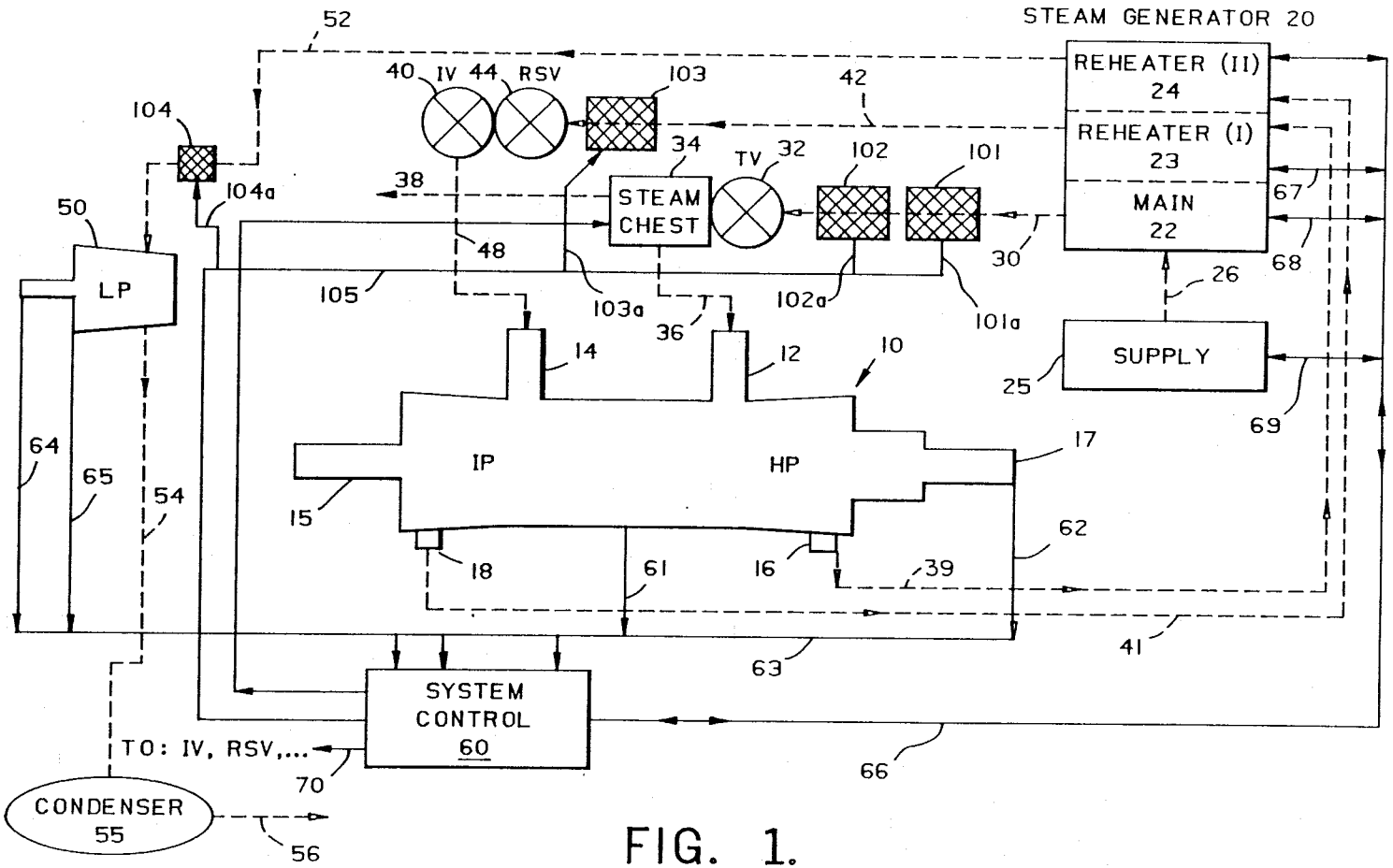
FIG. 1 is a simplified and combined, steam turbine heat balance diagram and control system schematic utilizing the solid particle magnetic deflection system of the invention, illustrating preferred and optional positions for the installation of electromagnets in association with the interconnecting piping.

FIG. 1, a simplified and combined heat balance diagram and system control schematic for a solid particle magnetic deflection system in accordance with the present invention, adopts a conventional notation of "dashed" lines representing steam flow interconnecting piping and "solid" lines representing multipath electrical circuit connections, which, variously, are also bidirectional as indicated therein by oppositely directed arrowheads. Whereas the system of the invention is suitable for use with any type of steam turbine, the steam turbine 10 schematically illustrated is of the combined high pressure (HP) - intermediate pressure (IP) reheat type, manufactured by Westinghouse Electric Corporation, assignee of the present invention. Accordingly, turbine 10 includes both a main steam inlet nozzle 12 and a reheater inlet nozzle 14 which receive respective steam flows, known as "main throttle steam", and "reheat steam", from a main steam generator, in a manner to be described, for supply to the respective HP and IP portions of the turbine 10. While schematically shown as single inlet nozzles 12 and 14, those skilled in the art will understand that a plurality of such nozzles are typically disposed circumferentially about the periphery of the turbine 10, relative to the central axis thereof, as defined by the rotor (not shown). Also shown in typical schematic notation is a power output 15 comprising, typically, an axle driven in rotation by the internal rotor of the turbine 10 (in turn driven by the main throttle steam and reheat steam), and a second end 17, comprising a further axle coupled to and driven by the internal rotor of the turbine 10 and connected to a governor or other similar device for maintaining selectively controlled speeds of rotation. The turbine 10 further includes outlet steam ports 16 and 18 from the HP and IP portions, respectively.

Steam generator 20 includes a main steam generator 22 and a reheater (I) steam generator 23 for servicing the turbine 10. Supply 25 supplies fluid, e.g. water, through interconnecting pipe 26 to the main steam generator 22, as required and in a known manner, either under manual control or through automated system control, as schematically indicated in FIG. 1 and described hereafter.

Main throttle steam from the main steam generator 22 is supplied through interconnecting piping 30 and a throttle valve (TV) 32 to a steam chest 34, from which a controlled supply of main throttle steam is provided through interconnecting piping 36 to the inlet nozzles 12 of the HP portion of turbine 10, as shown in FIG. 1. The steam chest 34 is conventional, and includes a plurality of valves for regulating the supply of the main throttle steam to the corresponding plurality of inlet nozzles 12, as before noted. As is also conventional, the steam chest 34 may include further controlled valves for providing additional outputs of main throttle steam, as indicated by interconnecting piping 38.

The steam from which energy has been extracted by the turbine 10 is recovered and removed through the outlet nozzle 16 and passes through interconnecting piping 39 for return to the steam reheater (I) 23. The reheated steam is supplied through interconnecting piping 42, a reheat stop valve (RSV) 44, an intercept valve (IV) 40 and further interconnecting piping 48 to the reheat steam nozzle 14. As in the case of the main throttle steam, it will be understood that a plurality of interconnecting pipes 48 and reheat steam inlet nozzles 14 are provided, the latter similarly extending circumferentially about the exterior of the turbine 10. The exhausted steam from exhaust outlet 18 is transported by return piping 41 to the reheater (II) 24, as subsequently explained.

It is to be understood that the flow paths, controls, and related components of an actual turbine system are far more complex than those illustrated by the simplified diagram of FIG. 1, and thus that FIG. 1 thus is intended primarily to indicate the basic steam flow paths, thereby to permit illustration of the incorporation of the solid particle magnetic deflection system of the present invention. For purposes of further illustration of the adaptability of the system of the invention to virtually any type of steam turbine generating system, there is further indicated a second, low pressure (LP) turbine 50 which may be of a type so designated and manufactured by Westinghouse Electric Corporation, and which may be driven by low pressure steam from an associated reheater (II) 24 of the steam generator 20. Specifically, as illustrated in FIG. 1, interconnecting piping 52 conveys a flow of low pressure steam from reheater (II) 24 to the low pressure turbine 50. In like fashion, the steam, from which energy has been extracted by the low pressure turbine 50 is recovered and transported through interconnecting piping 54 to a condenser 55; as indicated by arrow 56, the output of condenser 55 may then be returned through further apparatus, which may be conventional, to the supply 25.

System control 60 may be of conventional type, controlling start-up, sustained operation, and shut-down of the turbines 10 and 50. Thus, sensor outputs relating to internal conditions (e.g., pressure, temperature, etc.) and speed of rotation are derived from the turbine 10 and supplied over lines 61 and 62, respectively, and over bus 63 to the system control 66. Similar sensors associated with turbine 50 supply sensor outputs over leads 64 and 65, and through bus 63 to system control 60. A bi-directional bus 66 connects the system control 60 through corresponding bi-directional interconnections 67, 68 and 69 to the reheaters (I and II) 23 and 24, the main steam generator 22 and the supply source 25, respectively, of the steam generator 20. Similarly, over these same bus connections, controls generated by system control 60 are supplied to the identified components for regulating their operations and as well for coordinating the output of main throttle steam and reheat steam through the paths, before described, to the main turbine 10 and any associated turbine, such as the low pressure turbine 50. System control 60 furthermore provides control outlets in conventional fashion through a bus 70 to other system components, such as the TV valve 32, the IV valve 40, the RSV valve 44, the steam chest 34, and etc.

As noted at the outset, steam turbines, of the type illustrated in FIG. 1, are subject to severe erosion damage by impact of solid particles which are entrained in and carried by the steam flow into the interior of the turbine 10. It is believed that the primary source of the solid particles is oxidation of the interior surfaces of the boiler tubes in the steam generator 20 and particularly its main generator 22 and reheaters 23 and 24, producing a metallic oxide scale on those surfaces. That oxide scale is subject to exfoliation and thus separation from the interior of the tubes, at which time it becomes entrained in the steam flow from the steam generator, such as through the interconnecting piping 30, 42 and 52, and thus is delivered into the internals of the turbines 10 and 50. In fact, the oxide particles can cause damage to the stop and control valves, such as the TV, IV and RSV valves and the steam chest 34, illustrated in FIG. 1, while enroute to the turbines 10 and 50 within which the main damage occurs.

In accordance with the present invention, SPE is significantly reduced in amount and effect, by virtue of a solid particle magnetic deflection system, illustrated in FIG. 1 by the electromagnets 101 and 102 associated with piping 30, electromagnet 103 associated with interconnecting piping 42, and electromagnet 104 associated with interconnecting piping 52. Each of the electromagnets 101 through 104 is connected through corresponding leads 101*a*, 102*a*, 103*a*, and 104*a* to a power bus 105, over which electrical power is selectively supplied thereto by the system control 60.

As before noted, the primary occurrence of SPE is during start-up of the system, and thus after it has been brought off-line and allowed to cool. As the steam generator 20 (or boiler, as it is also called) is fired to bring the system into operation, the difference in thermal expansion characteristics between the oxide scale formed within the boiler pipes and the material of the pipes results in separation of the oxide from the tube walls, i.e. exfoliation. Thus, in accordance with the practice of the present invention, system control 60 provides electrical power to the electromagnets 101 through 104, preferably, selectively, at the time of start-up. Typically, power is supplied throughout the time required to return the system to normal, sustained operation. Additionally, since varying load conditions present the potential for further such exfoliation, system control 60 may selectively energize the electromagnets 101–104 during such time period as is required for the system to return to a stable level of sustained operation.

Figure 2:
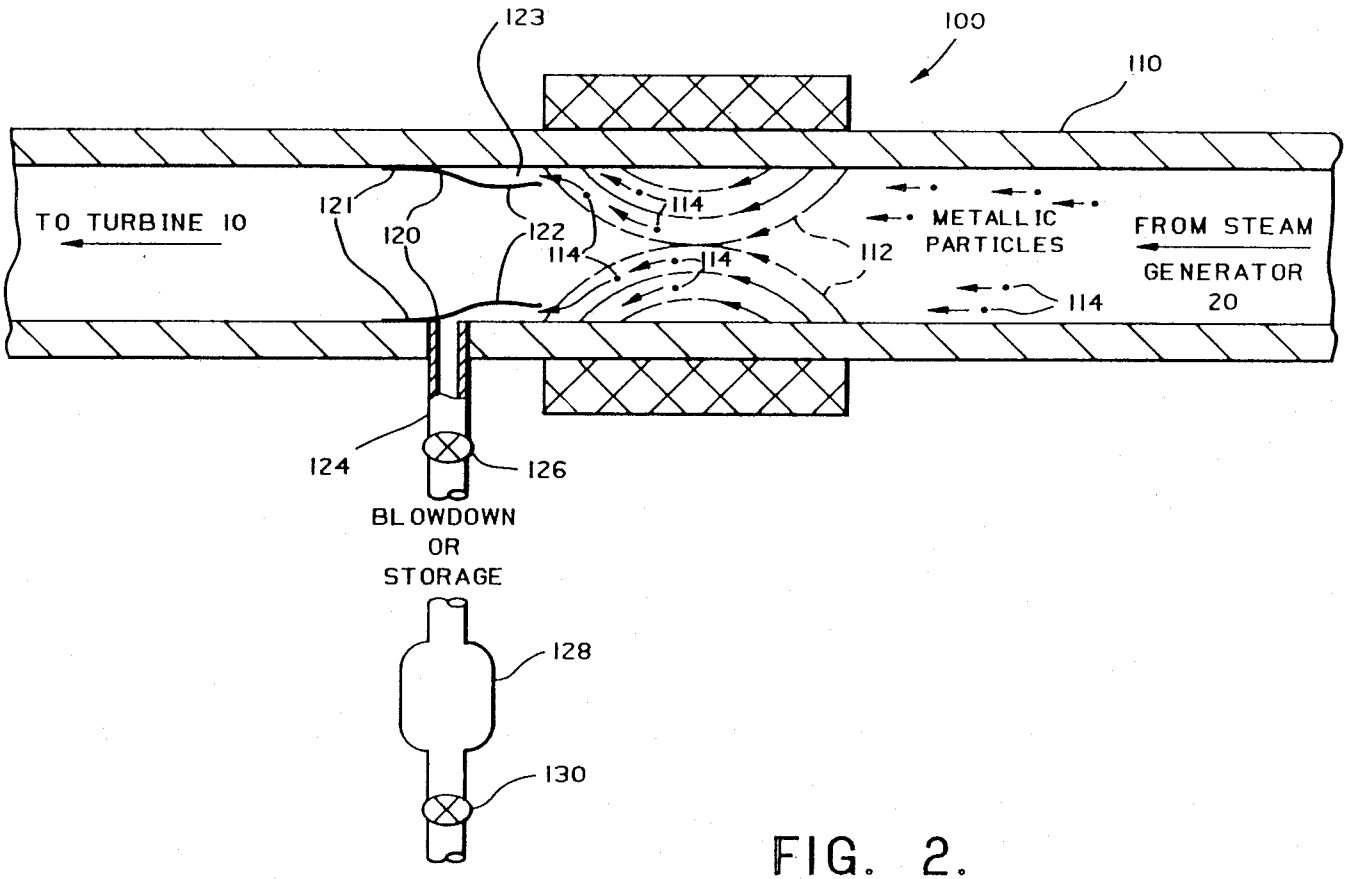
FIG. 2 is a schematic, cross-sectional view, taken in a plane parallel to the plane of the drawing of FIG. 1 and passing through the common axis of a selected length, or section, of interconnecting piping having a circumferential electromagnet mounted thereabout, for indicating the magnetic field effect and the deflection, trapping and accumulation of solid metallic particles achieved thereby.

FIG. 2 is a schematic, cross-sectional view, taken in a plane through the axis of a selected length, or section, of the interconnecting piping 110 about which an electromagnet 100 is circumferentially mounted, the piping 110 and electromagnet 100 corresponding, for example, to any of the interconnecting piping, such as 30, 42 and 52 and respectively associated electromagnets 101 and 102, 103 and 104, shown in FIG. 1. Steam from the steam generator 20 (which may be either from the reheater 24 or the main generator 22) is illustrated in FIG. 2 as entering from the right of the piping 110, and carrying therein entrained metallic particles 114 exfoliated from the interior surfaces of the boiler tubes. Significantly, it has been determined that the majority of such solid particulate matter is the metallic oxide, $Fe_2O_3$ (magnetite). That material has a Curie temperature which is significantly higher than the temperatures of the main throttle steam and reheat steam. This is important, since above the Curie temperature, a material otherwise capable of being magnetized will no longer exhibit that property. By way of example, the Curie temperature for silicon steel is 1390° F. and that for ingot iron is 1420° F. The supply of electrical power to the electromagnet 100 thus serves to magnetize the metallic particles 114 and direct or divert them out of the generally axial flow path of the steam to one or more predetermined locations, at which they are trapped and accumulated. A flow of steam, substantially free of such metallic oxide particles, then proceeds to the turbine 10, as illustrated in FIG. 2.

In the particular configuration of FIG. 2, the field 112 from the electromagnet 100 directs the metallic particles 114 into an annular trap formed by a surface skimmer device 120. The skimmer device 120 is of conical configuration, having a first end 121 of substantially the same outer diameter as the inner diameter of the pipe 110 and which is secured at its outer periphery to the interior of the pipe 110. The skimmer device 120 reduces in diameter in a direction toward its second end 122 which thus projects radially inwardly and in an up-stream direction, forming an annular trap 123 with the opposed, interior circumferential surface of the pipe 110. An outlet pipe 124 penetrates the sidewall of the pipe 110 in the vicinity of the annular trap 123 formed by the skimmer 120. By opening valve 126, accumulated metallic particles may be removed from the trap by "blowdown" or, in the alternative, may be collected in a tank 128. Preferably, the valve 126 is opened for transporting the accumulated metallic particles 114 from the annular trap 123 into the tank 128 and then closed, following which valve 130 is opened for removal of the metallic particles from the storage tank 128.

With reference to FIG. 1, plural electromagnets of the type 100 shown in FIG. 2 may be associated with any given interconnecting pipe, as illustrated by electromagnets 101 and 102 associated with piping 30 in FIG. 1. As will be understood, metallic particles of different sizes, or masses, will be given different deflection trajectories by the magnetic field of a given electromagnet and thus of a given field strength. Accordingly, plural electromagnets providing respective magnetic fields of different, predetermined strengths, may be produced by positioning the corresponding electromagnets in serial succession, spaced along the axis of the piping 110. By appropriate selection of other respective magnetic field strengths, metallic particles of corresponding different sizes or masses may be suitably diverted through desired deflection trajectories to predetermined locations relative to each electromagnet. Thus, with concurrent reference to FIGS. 1 and 2, it will be understood that each of plural electromagnets 101 and 102 may have respectively corresponding skimmers 120 associated therewith or, by an appropriate selection of the field strengths, a single skimmer 120 may be employed with a plurality of such electromagnets. It will also be understood that several blowdown pipes 124 and associated valves, as shown in FIG. 2, may be disposed circumferentially about the annular trap 123 of each skimmer 120.

Figure 3:
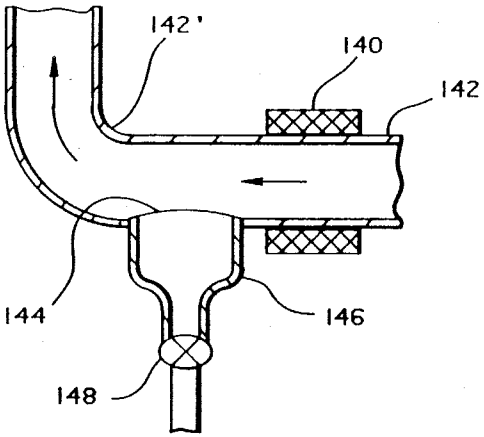
FIG. 3 is a schematic, cross-sectional view, similar to that of FIG. 2, of a second embodiment of the invention, which utilizes a quiescent zone associated with a selected length of interconnecting piping, into which the metallic particles entrained in the steam flow are deflected and accumulated.

FIG. 3 illustrates an alternative structural configuration for collection of deflected metallic particles in accordance with the deflection system of the invention. Specifically, an electromagnet 140 is positioned circumferentially about a section of interconnecting piping 142 adjacent an opening 144 in a sidewall of the piping 142 at which a reservoir 146 is joined, the bottom end of which is closed by a valve 148. Preferably, the piping passes through a right angle turn as illustrated at 142', just beyond the opening 144, in the direction of flow (shown by the arrows). The field of the electromagnet 140 then is selected so as to project, or deflect, the metallic particles from the incoming flow and into the quiescent zone afforded by the reservoir 146, from which accumulated such metallic particles may be removed by operation of valve 148.

Figure 4:
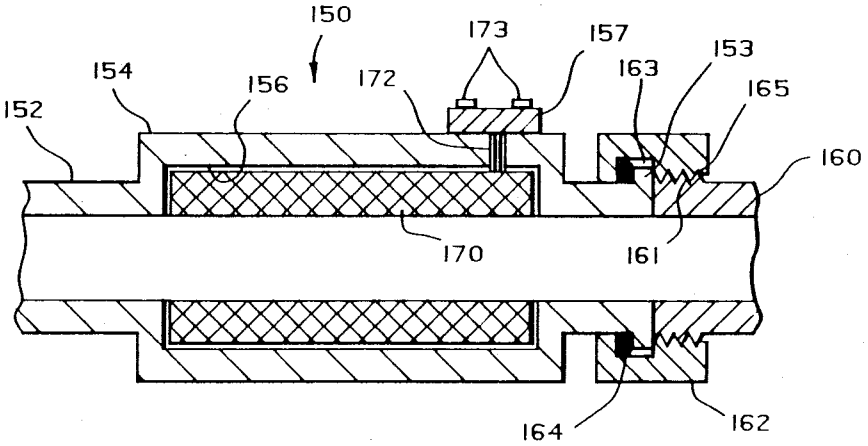
FIG. 4 is a schematic, cross-sectional view of an alternative electromagnet assembly for installation in a selected position in the steam flow path, and for use in accordance with the present invention.

FIG. 4 is a simplified, cross-sectional view of an electromagnetic assembly for use in the deflection system of the invention. Particularly, the electromagnetic assembly 150 includes a length of piping 152 having end portions of the same interior and exterior diameters as those of a section of interconnecting piping 160 with which it is to be used, and an enlarged diameter central portion 154 defining therein an annular recess 156 of an enlarged diameter, relative to the interior diameter of the piping 152. Connection of the assembly 150 to the piping 160 is afforded by a nut 162 having an interior recess 163, received over an outward annular flange 153 and engaging a seal 164 therebetween. Piping 160 includes exterior threads 161 at its end to which the assembly 150 is to be connected, and is engaged by the interior threads 165 of the nut 162.

Electromagnet 170, of generally annular configuration, is received in the mating recess 156, with electrical output leads 172 passing through the sidewall 154. Seal 157 then is secured in position, while affording access to terminals 173 of the with electromagnet 170 for supplying electrical power thereto. Preferably, a seal (not shown) is affixed on the interior surface of the electromagnet 170 for physically isolating same from the steam flow. Such a seal may be afforded, for example, by a coaxial, cylindrical sheet of stainless steel or other material which extends over and thus encloses the recess 156 and is suitably affixed in position at its opposite ends to the interior sidewall of the pipe 152. The broken-away end of the pipe 152 in FIG. 4 may be of any desired configuration. For example, a further threaded nut arrangement, similar to nut 162, may be afforded for threaded connection to a corresponding, further length of interconnecting piping 160. Alternatively, the assembly 150 at FIG. 4 may be associated with a reservoir such as the reservoir 146 at FIG. 3, from which a suitable, further interconnection is provided. Alternatively, the assembly 150 of FIG. 4 may be welded directly in position, intermediate two segments of interconnecting pipes 160, to afford a substantially permanent installation.

In accordance with the foregoing, the solid particle magnetic deflection system of the invention affords an efficient and effective, selectively controllable means for deflection and removal of metallic particles entrained in the flow of steam from a steam generator while enroute to a turbine, and is effective for achieving a significant reduction in the serious problem of solid particle erosion to which present day steam turbine systems are subjected. Numerous modifications and adaptations of the system of the invention will be apparent to those of skill in the art, and thus it is intended by the appended claims to cover all such modifications and adaptations, which fall within the true spirit and scope of the present invention.

We claim as our invention:

1. A method for removing metallic particles from a flow of steam supplied by a steam generator through a supply path to a steam turbine, the metallic particles being entrained in the flow of steam and, at least in part, having defoliated from boiler pipes of the steam generator, comprising:

defining an axial section of a predetermined axial direction, circumferential configuration and length, in the steam flow path from the steam generator to the steam turbine;

producing a magnetic field in the said defined section of the steam flow path, having an axis generally aligned with the predetermined axis thereof, the field being of a strength to deflect entrained metallic particles from the predetermined axial direction of flow and outwardly, toward the outer circumference of the axial path section; and trapping and collecting the deflected metallic particles, thereby to remove same from the flow of steam supplied to the turbine.

2. A method as recited in claim 1 wherein the flow of steam is supplied through interconnecting piping from the steam generator to the steam turbine, and wherein:

the step of defining a flow path section is performed by selecting a section of interconnecting piping having a predetermined axial direction, adjacent the input to the turbine;

the step of establishing a magnetic field is performed by mounting an electromagnet circumferentially about the selected section of interconnecting piping and supplying electrical energy thereto so as to establish the said magnetic field within the selected section of interconnecting piping.

3. A method as recited in claim 2, wherein:

the step of trapping and collecting the deflected metallic particles is performed by mounting a skimmer device within the said selected section of piping at a downstream position selected relatively to the electromagnet, said skimmer device being of generally conical configuration and having a first end affixed at its outer periphery to the interior of the selected section of piping and having an up-stream projecting and radially inwardly disposed second end defining an annular trap with the opposed interior surface of the piping, the said downstream position of said skimmer being selected relative to the magnetic field so as to trap the deflected metallic particles in the annular trap.

4. A method as recited in claim 3, further comprising: periodically removing accumulated, trapped magnetic particles from within the annular trap.

5. A method as recited in claim 2, wherein: the step of trapping and collecting the deflected metallic particles is performed by providing a quiescent region in communication with the selected section of piping and extending radially therefrom through the sidewall of the selected section of piping, selectively positioned relative to the magnetic field so as to receive therein the metallic particles deflected from the axial direction of flow and to accumulate same therein, thereby for removal from the steam flow.

6. A method as recited in claim 1, further comprising: providing plural, axially aligned magnetic fields in serial, adjacent relation and of respective, different strengths for deflecting respectively corresponding metallic particles of corresponding, different masses, from the steam flow.

7. A method as recited in claim 1, further comprising: selectively establishing said magnetic field for a selected time period, concurrently with start-up of the steam generator following a shut-down condition.

8. A method as recited in claim 7, further comprising: terminating the magnetic field upon reaching stable and continuous operation of the steam generator and steam turbine.

9. A method as recited in claim 8, further comprising: selectively re-establishing the magnetic field during periods of varying load conditions on the steam turbine and the steam generator.

10. A system for removing metallic particles from a flow of steam being supplied by a steam generator to a steam turbine, the metallic particles being entrained in the flow of steam and, at least in part, having exfoliated from boiler pipes of the steam generator, comprising:

means for defining a section, of a predetermined axial direction, circumferential configuration and length, of the steam flow path from the steam generator to the steam turbine;

means for producing a magnetic field in the said defined section of the steam flow path, having an axis generally aligned with the predetermined axis thereof, the field being of a strength to deflect entrained metallic particles from the predetermined axial direction of flow and outwardly, toward the outer circumference of the axial path section; and means for trapping and collecting the deflected metallic particles, thereby to remove same from the steam flow supplied to the turbine.

11. A system as recited in claim 10 wherein the flow of steam is supplied through interconnecting piping from the steam generator to the steam turbine, and wherein:

said path defining means comprises a section of said interconnecting piping, selected adjacent the input to the steam turbine;

said magnetic field producing means comprises an electromagnet mounted circumferentially about said selected section of interconnecting piping and means for supplying electrical power to said electromagnet.

12. A system as recited in claim 11 wherein:

said trapping and collecting means comprises a skimmer device of generally conical configuration having a first end affixed at its outer periphery to the interior of said selected section of piping and having a radially inwardly disposed second end projecting in an upstream direction within said selected section of piping and defining an annular trap with the opposed, interior surface of said piping; and said skimmer device being positioned relative to the magnetic field established upon energization of said electromagnet so as to trap and collect metallic particles deflected into the annular trap by the magnetic field of said electromagnet.

13. A system as recited in claim 12, further comprising:

a pipe having a first, open end extending radially and in sealed relationship through the selected section of piping and into communication with the annular trap and having a second, open end; and a valve closing said second, open end of said pipe and selectively movable from a closed to an open position to permit blowdown and passage therethrough of accumulated metallic particles from the annular trap.

14. A system as recited in claim 13, further comprising:

a storage tank having a first, open end connected to the outlet of said valve and a second, open end; and a further valve connected to said second, open end of said storage tank and movable selectively from a closed position in which accumulated metallic particles blowndown through said first valve in said open position are received in said storage tank, and an open position for removal of metallic particles from said storage tank.

15. A system as recited in claim 11, further comprising:

a reservoir having an open, upper end connected to and communicating with the selected section of piping and extending radially therefrom at the downstream end thereof at a position selected, relative to the magnetic field, so as to receive therein the metallic particles deflected from the axial direction of flow;

said reservoir defining a quiescent region for accumulating the metallic particles deflected thereinto and having a second, lower and open end; and a valve connected to said second, lower and open end of said reservoir and selectively operable from a closed to an open position for discharging accumulated metallic particles from within said reservoir.

16. A system as recited in claim 10, further comprising:

plural electromagnets mounted in serial, adjacent relation and in axial alignment circumferentially about said selected section of piping;

said plural electromagnets producing respective magnetic fields of different strengths for deflecting respectively corresponding metallic particles of corresponding, different masses to respective, predetermined locations relative to the respective said magnets, from the axial steam flow.

17. A system as recited in 16, wherein the respective, different magnetic field strengths of said respective electromagnets deflect the corresponding metallic particles of respective, different masses, to a common, predetermined location.

18. A system for removing metallic particles from a flow of steam, comprising:

a steam generator;

a steam turbine having at least a first set of inlet nozzles;

interconnecting piping connecting said steam generator to said first set of inlet nozzles of said steam turbine for supplying a flow of steam from said steam generator to said steam turbine;

means for producing a magnetic field within a selected section of said interconnecting piping adjacent the connection thereof to said inlet nozzles of said steam turbine, said field having an axis generally aligned with the axial direction of steam flow within said selected section of interconnecting piping and being of a strength for deflecting metallic particles, entrained in the generally axial direction of steam flow, outwardly toward a predetermined portion of the interior circumference of and at a predetermined location within said selected section of piping; and means disposed at said predetermined location of the interior surface of said selected section of piping for trapping and collecting the deflected metallic particles, thereby to remove same from the flow of steam supplied to the turbine.

19. A system as recited in claim 18, further comprising:

system control means connected to said turbine and to said steam generator for selectively controlling the operation of each thereof, including shut-down, start-up, and sustained operating conditions thereof, said system control means further being connected to said magnetic field producing means for selective energization thereof; and said system control means selectively energizing said magnetic field producing means concurrently with controlling start-up of said steam generator and said turbine and for a sufficient duration thereafter until said steam generator and said turbine reach a sustained operating condition.

20. A system as recited in claim 19, wherein:

said system control means further comprises sensors connected to said turbine and said steam generator for monitoring the operating conditions thereof, including detecting varying load conditions; and said system control means responding to a detected varying load condition to selectively energize said magnetic field producing means during each said interval of varying load conditions until sustained operation is re-established.

21. A system as recited in claim 18, wherein:

said turbine comprises first and second, relatively higher and lower pressure level turbine portions, first and second sets of steam inlet nozzles associated with said respective, first and second different pressure level turbine portions and first and second exhaust ports;

said steam generator comprises a main steam generator portion and a first reheater steam generator portion;

said interconnecting piping comprises main interconnecting piping for connecting said main steam generator portion to said first set of inlet nozzles and reheater interconnecting piping for connecting said first reheater portion of said steam generator to said second set of inlet nozzles;

said first exhaust port recovering and exhausting steam supplied to said turbine from which energy has been extracted by said turbine; and said interconnecting piping further comprises return interconnecting piping connecting said first exhaust port of said turbine to said first reheater portion of said steam generator, for supplying exhausted steam from said turbine to said first reheater portion of said steam generator.

22. A system as recited in claim 21, wherein there is further provided:

a second turbine, of lower pressure than that of the second turbine portion of the first turbine, having inlet nozzles and an exhaust port;

a condenser;

said steam generator further comprises a second reheater steam generator portion;

said interconnecting piping further comprises second reheater interconnecting piping connecting said second reheater portion of said steam generator to said inlet nozzles of said second steam turbine and second return interconnecting piping connecting said exhaust port of said second turbine to said condenser for collecting and exhausting steam from which energy has been extracted by said second turbine and supplying same to said condenser; and means for producing a magnetic field in said second reheater interconnecting piping adjacent said inlet nozzles of said second turbine adjacent the input to said second turbine, having a magnetic axis generally aligned with the predetermined axis of the steam flow path therein, the field being of a strength to deflect entrained metallic particles from the predetermined axial direction and outwardly toward the outer circumference of the axial path; and means for trapping and collecting the deflected metallic particles, thereby to remove same from the reheated steam flow supplied to said second turbine.

* * * * *